US005632445A

United States Patent [19]

Dubruque

[11] Patent Number: 5,632,445

[45] Date of Patent: May 27, 1997

[54] ULTRASONIC FLUID SPRAYING DEVICE

[76] Inventor: Dominique Dubruque, 644 chemin des Farnaises, 74380 Bonne-sur-Menoge, France

[21] Appl. No.: 386,218

[22] PCT Filed: Nov. 22, 1991

[86] PCT No.: PCT/FR91/00930

§ 371 Date: May 21, 1993

§ 102(e) Date: May 21, 1992

[87] PCT Pub. No.: WO92/09373

PCT Pub. Date: Jun. 11, 1992

Related U.S. Application Data

[63] Continuation of Ser. No. 66,022, May 21, 1993, abandoned.

[30] Foreign Application Priority Data

Nov. 22, 1990 [FR] France ..... 90 14572

[51] Int. Cl.[6] ..... B05B 1/08

[52] U.S. Cl. ..... 239/102.2; 239/139

[58] Field of Search ..... 239/102.1, 102.2, 239/128, 133, 135, 139

[56] References Cited

U.S. PATENT DOCUMENTS

| | | | |
|---|---|---|---|
| 3,114,654 | 12/1963 | Nishiyama et al. | 239/102.2 |
| 3,243,122 | 3/1966 | Snaper | 239/102.2 |
| 3,696,259 | 10/1972 | Mori et al. | 310/8 |
| 3,738,574 | 6/1973 | Guntersdorfer et al. | 239/102.2 |
| 4,402,458 | 9/1983 | Lierke et al. | 239/102.2 |
| 4,659,014 | 4/1987 | Soth et al. | 239/102.2 |
| 4,850,534 | 7/1989 | Takahashi et al. | 239/102.2 |
| 4,978,067 | 12/1990 | Berger et al. | 239/102.2 |

FOREIGN PATENT DOCUMENTS

| | | | |
|---|---|---|---|
| 390603 | 10/1990 | European Pat. Off. | 239/102.2 |
| 3036721 | 4/1982 | Germany . | |
| 8518975 | 12/1988 | Germany . | |
| 688242 | 9/1979 | U.S.S.R. | 239/102.2 |
| 963570 | 2/1982 | U.S.S.R. | 239/102.1 |

*Primary Examiner*—Andres Kashnikow
*Assistant Examiner*—Lisa Ann Douglas
*Attorney, Agent, or Firm*—Blakely Sokoloff Taylor & Zafman

[57] ABSTRACT

An ultrasonic fluid spraying device including an electroacoustic converter; optionally at least one coupling rod element; a spraying device provided as a radial collar projecting outwards from an axial element with which it is integral, and tuned to the frequency of the converter; and devices for supplying the fluid to the immediate vicinity of an operative area of the spraying device.

25 Claims, 7 Drawing Sheets

ULTRASONIC FLUID SPRAYING DEVICE

Figure 1:
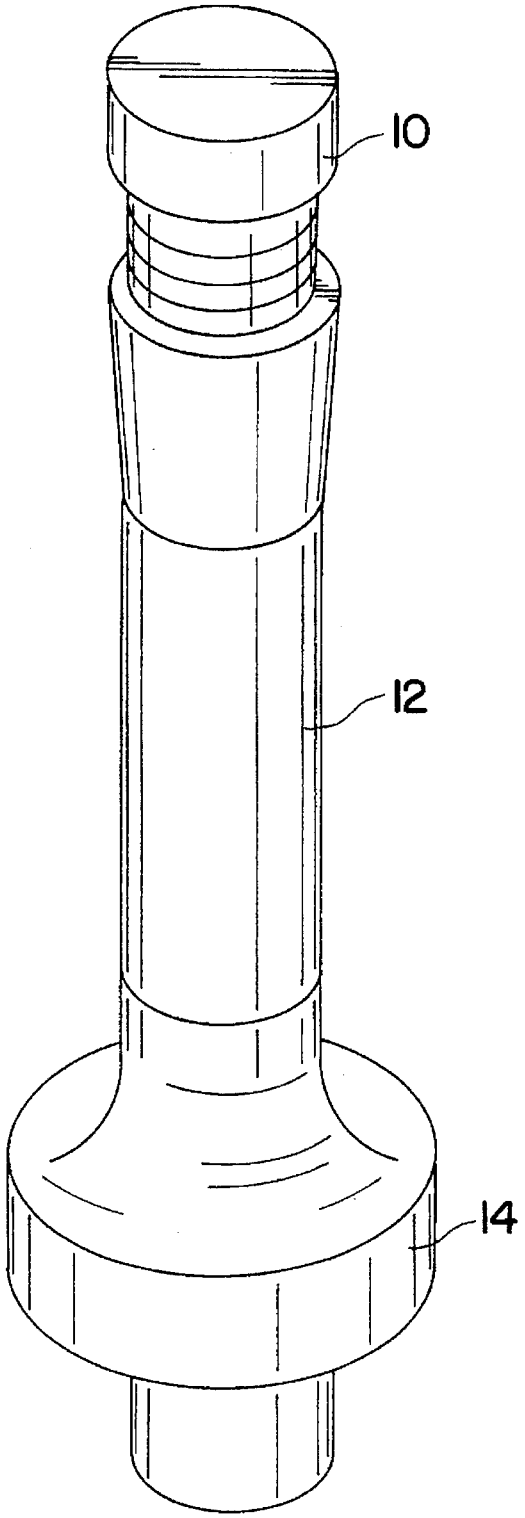

This is a continuation of application Ser. No. 08/066,022 filed May 21, 1993, now abandoned.

The present invention relates to an ultrasonic fluid spraying device.

Within the context of the present invention, the term "fluids" is understood to denote, very generally, all types of conventional fluids such as solutions based on various inorganic or organic compounds and/or solvents, emulsions, suspensions, dispersions or similar, as well as molten metals and alloys.

Consequently, this type of sprayer finds industrial applications in very many fields. By way of non-limiting examples, it is appropriate to mention domestic or industrial air humidifiers, for example used in air conditioning plants, oil burners, metallization sprayers, especially for depositing reflecting layers by metallization under vacuum of plastic components or similar.

Finally, this type of device is also used for generating powders by vaporization of the associated liquid phase.

It is also possible to use this type of sprayer with a supply of a number of liquids, in order to provide intimate mixtures, or else to carry out reactions in the vapor state.

As might be expected, for some specific type of application, it is necessary to combine, with the sprayer, heating means and/or means for adjusting this sprayer in a leaktight chamber in which a controlled gas atmosphere prevails.

It is appropriate, first of all, to recall that ultrasonic spraying is based on the generation of stationary surface waves, at the liquid/gas interface, arranged in the form of a perfectly regular lattice.

The distance between two consecutive peaks of the lattice determines the mean diameter of the drops formed.

It has been observed that it was important to have available a large active surface area for the purpose of increasing the throughput of the sprayer while remaining within the optimum operating region.

Conventional ultrasonic sprayers of axial type are restricted in size by the fact that, in order to operate coherently and homogeneously, the surface area of their active region cannot exceed a value which depends directly on the excitation frequency.

Thus, a cylindrical component made of titanium vibrating at 20 KHz [sic] cannot have a diameter of the active face greater than 80 mm without suffering the appearance of an undesired radial vibration in superposition at this spot, the consequence of which is overheating followed by fracturing of the component.

The state of the prior art may be illustrated by Belgian Patent No. 888,375 which describes a type of sprayer using flexural resonators. This type of device, which is supposed to make it possible to increase the throughputs significantly, has the disadvantage, however, of vibrating nonhomogeneously.

The active face of these sprayers has, depending on its dimensions and its shape, a sequence of wave antinodes and nodes and vibrates with a more or less large amplitude depending on whether the excitation axis is being moved away from or approached.

This translates into a greater particle size dispersion: the regions of high amplitude generate drops of large size and the regions of low amplitude drops of small size.

Moreover, the existence of regions of maximum stress in parts of unsuitable shape can lead to rupturing of the system.

The aim of the present invention is thus to propose a radial spraying device which makes it possible to spray large throughputs of fluids while retaining a tight particle size distribution and while ensuring perfect reliability at the level of the behavior of the constituent materials.

In accordance with the present invention, the ultrasonic sprayer is characterised in that it comprises:

an electroacoustic converter, optionally at least one coupling rod element, which makes it possible, if appropriate, to move the converter away from the sprayer.

a radial sprayer constructed in the shape of a radial collar projecting outwards with respect to the said rod element and tuned to the frequency of the said converter, and means for introducing the said fluid to be sprayed into the immediate vicinity of the active region of the said sprayer.

In the case of use at high temperatures, the ultrasonic sprayer will preferably comprise one or a number of coupling rod elements, which also makes it possible to facilitate the construction of the device.

Figure 2:
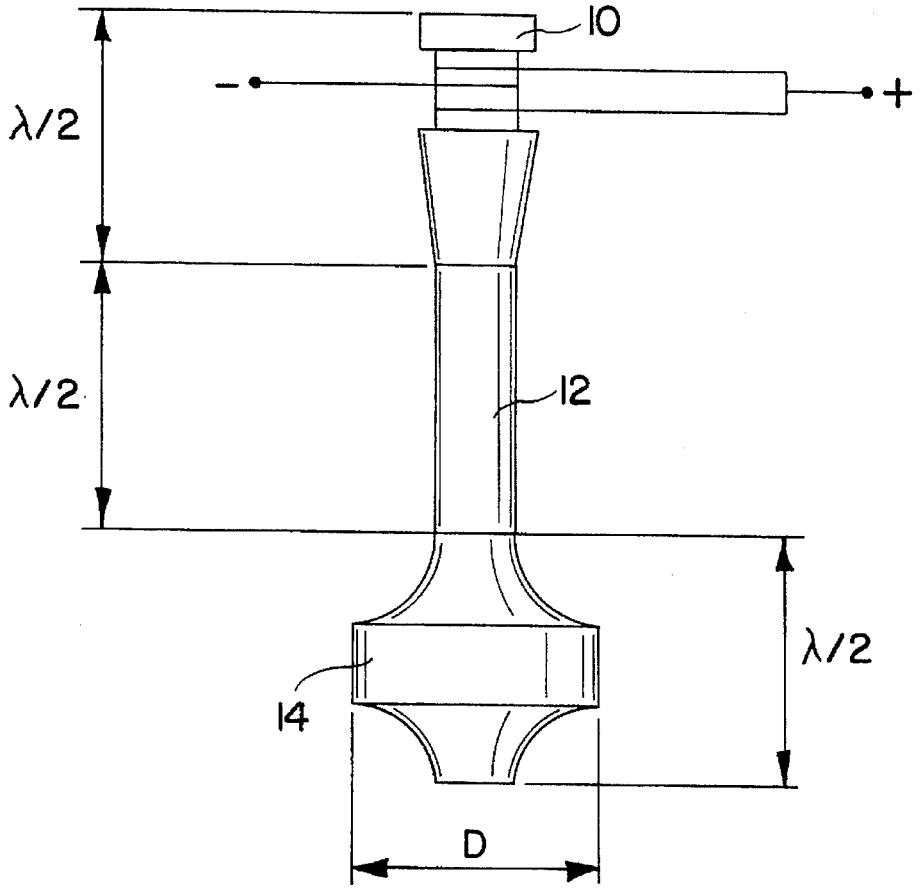
Figure 3A:
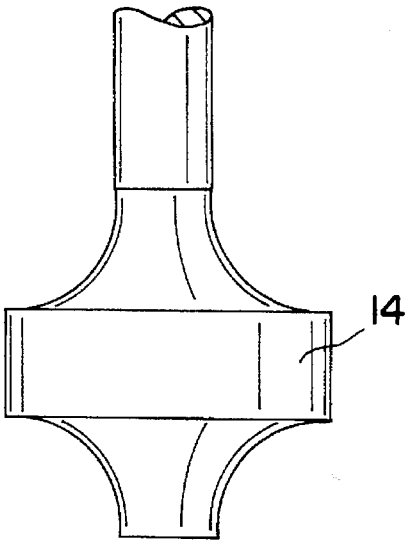
Figure 3B:
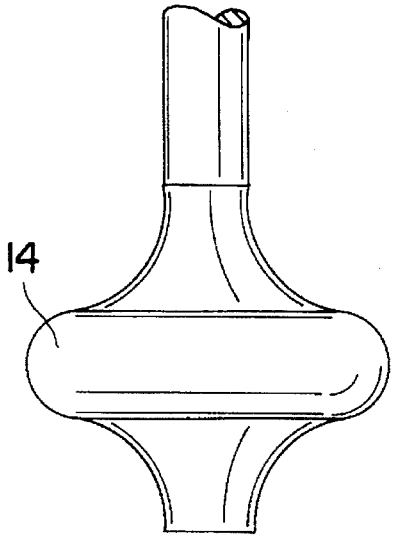
Figure 4:
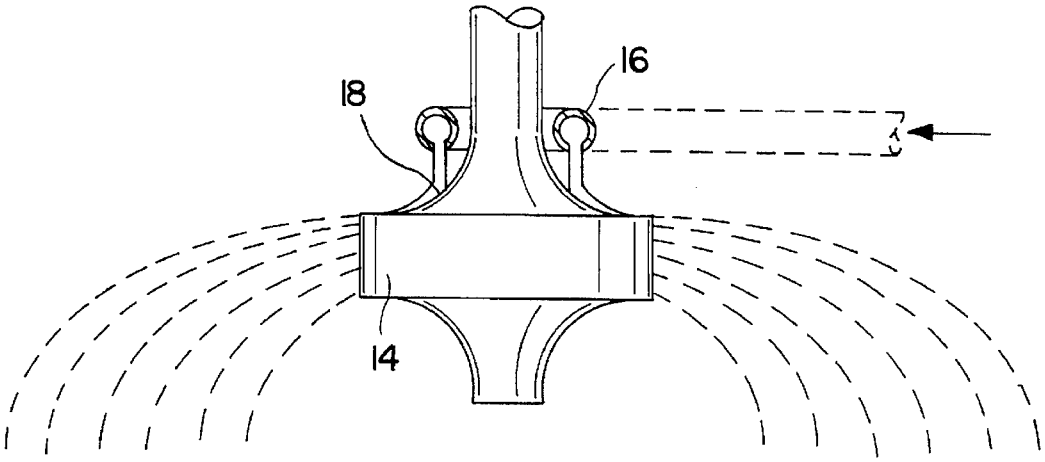
Figure 8:
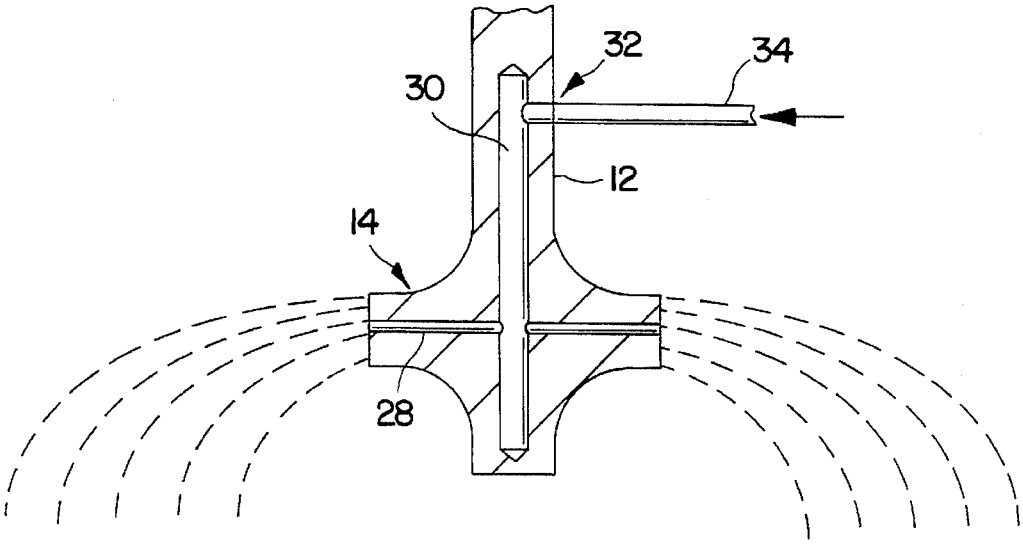
Figure 5:
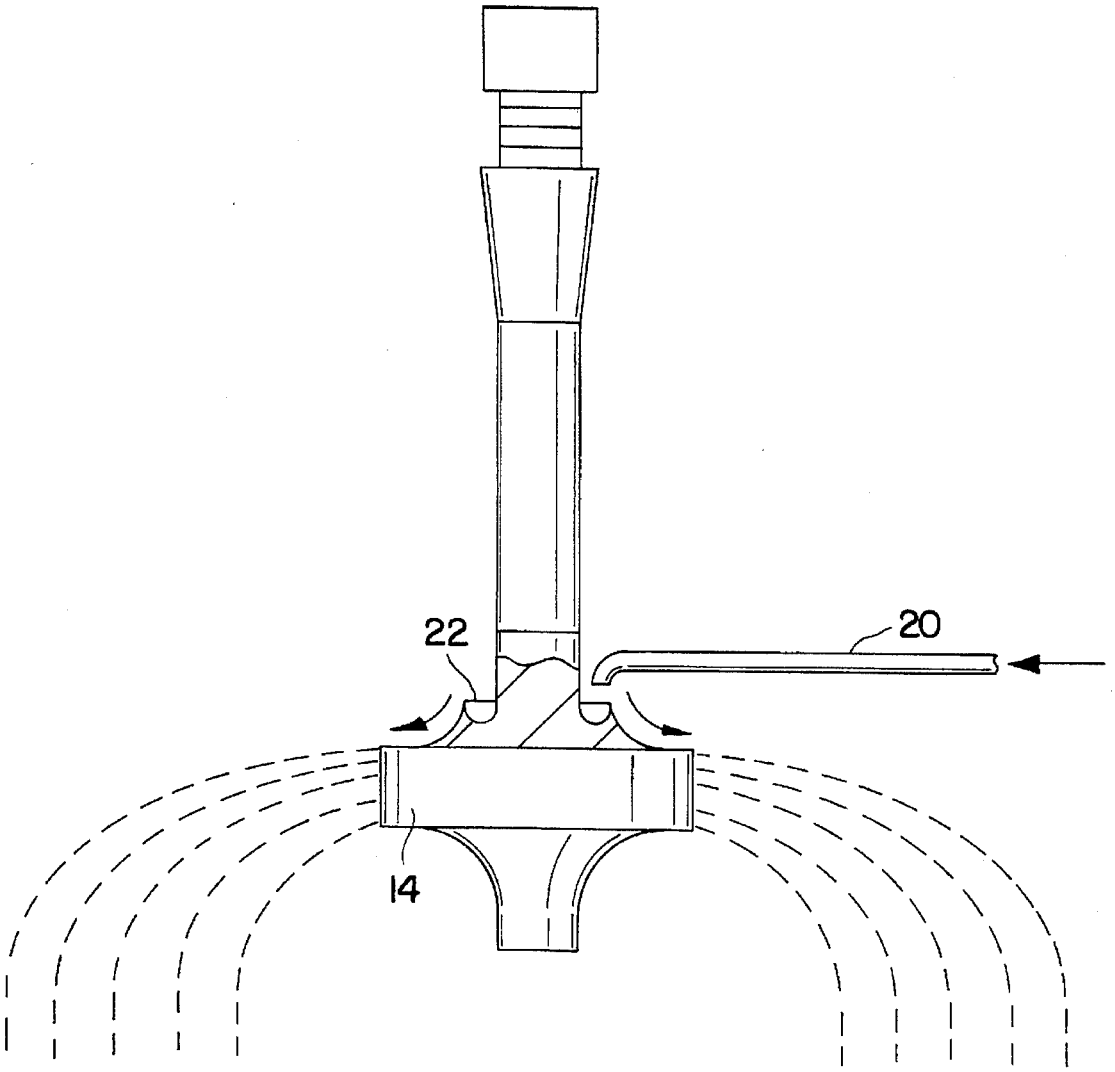
Figure 6:
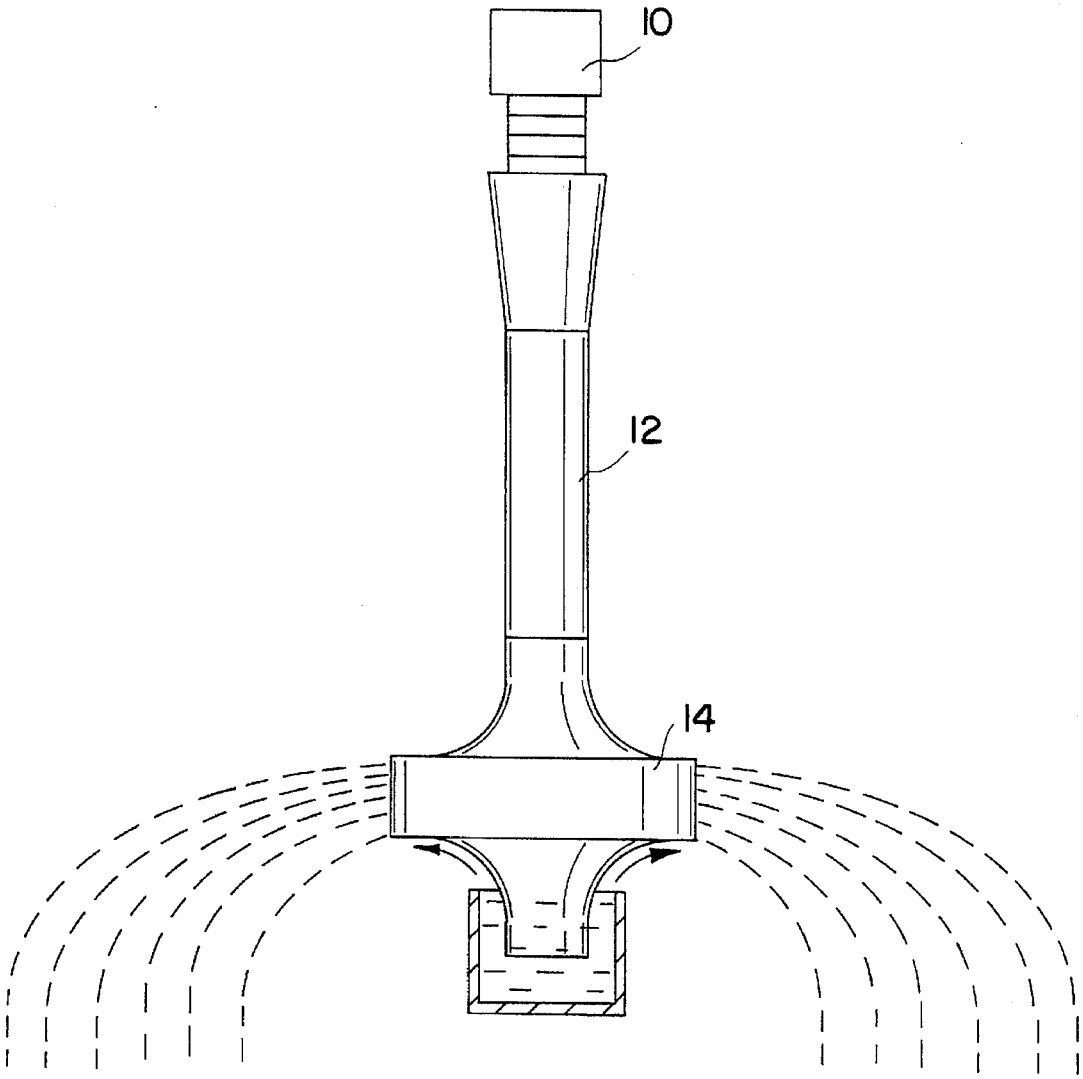
Figure 7:
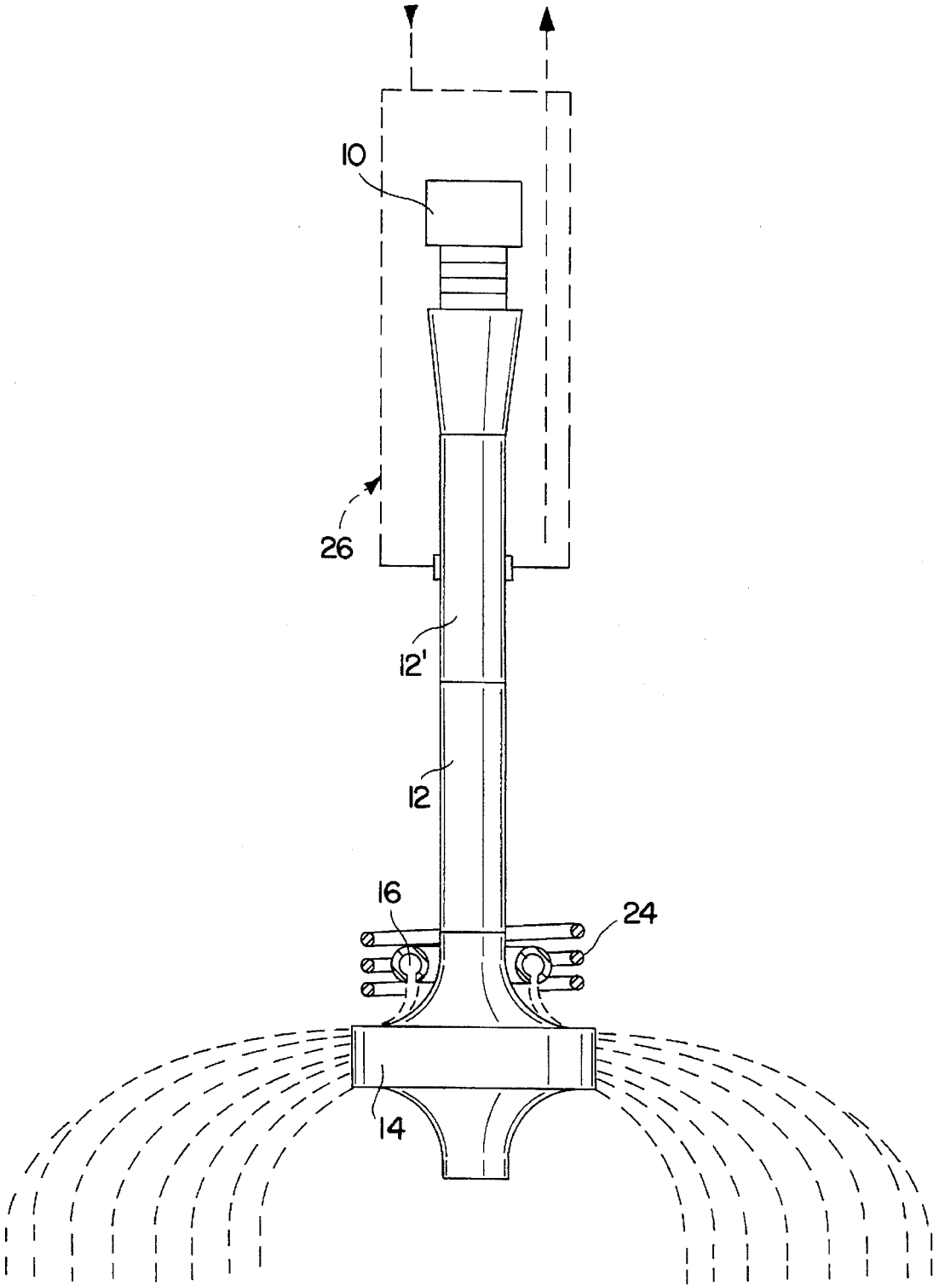
Figure 9:
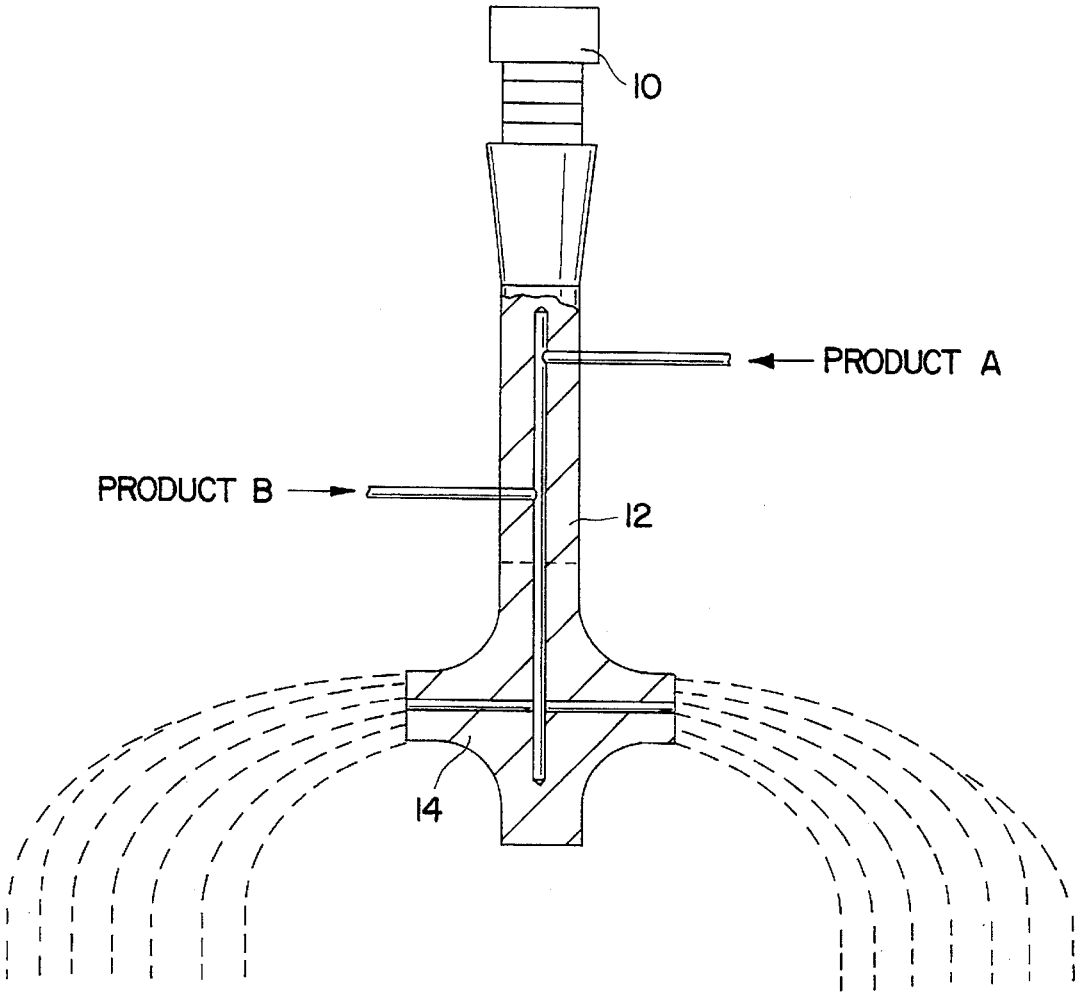

Other characteristics and advantages of the present invention will become apparent when reading the detailed description given below of a certain number of specific embodiments and especially with respect to the appended drawings, in which:

FIG. 1 represents a view in perspective of the whole of the spraying device according to the invention, FIG. 2 represents a schematic side view of the device of FIG. 1, FIG. 3*a* represents a sprayer whose side face is cylindrical, FIG. 3*b* represents a sprayer whose side face is convex, FIG. 4 represents a part of the spraying device provided with an external supply, by an annular perforated distribution pipe, FIG. 5 represents a spraying device equipped with a liquid distributor, FIG. 6 represents a spraying device equipped with a supply via a capillary effect, FIG. 7 represents a spraying device intended for the treatment of high-temperature liquids, FIG. 8 represents a spraying device provided with an internal supply, and FIG. 9 represents a spraying device provided with a double internal supply.

The device represented in the view in perspective of FIG. 1 contains, in its upper part, an electroacoustic converter of the type having piezoelectric excitation.

It can, for example, be of the "triplet and Langevin" type as described in the work High Intensity Ultrasonics by B. Brown and J. E. GOODMAN [sic].

Throughout the present description, this electroacoustic converter will carry the reference 10.

The spraying device according to the invention optionally comprises at least one coupling rod 12, as well as a sprayer constructed in the shape of a radial collar 14 projecting outwards with respect to the axial element with which it is integral.

The radial collar 14 is excited from the axial mode of the abovementioned element, on which it is centred.

It will be observed that during the axial compression stage, the radial collar 14 expands, and vice versa.

Such as is represented in FIG. 2, the radial collar 14 of the sprayer is constructed at the center of a half-wavelength of the axial vibration.

It will also be observed that the external diameter D of the radial collar 14 is advantageously determined to ensure that the vibration of the said collar is in resonance with the axial system. The methods of calculating such systems are well known to those skilled in the art and are especially described in U.S. Pat. No. 3,696,259.

The diameter of the active collar is directly linked to the excitation frequency which can range from 10 to 100 KHz [sic].

The amplitude of vibration of the radial collar is homogeneous throughout the active region.

It can be adapted to the viscosity of the liquid to be treated by using a rod 12 for coupling to the converter 10 having a suitable shape.

According to a specific characteristic of the device according to the present invention, the active side face of the radial collar 14 can be constructed cylindrically having an axis parallel to the axial vibration.

This embodiment is illustrated in FIG. 3*a*.

In accordance with another embodiment described in FIG. 3*b*, the active side face of the radial collar 14 can have a convex shape, the amplitude of vibration varying in this case slightly from one point of the face to another point of different level.

Supplying the liquid to be treated can be carried out via the outside of the device close to a nodal region, that is to say of low activity, or else via the inside of the device by virtue of perforations of small diameter made in regions of low stress.

According to a specific embodiment, illustrated in the appended FIG. 4, the means for introducing the liquid consist of an annular perforated distribution pipe 16 producing a direct flow onto the region for connecting 18 to the active side face of the collar 14.

This is only a specific embodiment in which the liquid flows freely or else by excess pressure from the annular perforated distribution pipe 16 towards the active side face of the collar 14.

In the specific embodiment described, with reference to FIG. 5, it is observed that the means for introducing the fluid consist of a pipe 20 dispensing the fluid into an annular distribution groove 22 made in the vicinity of the upper part of the connection of the sprayer to the coupling rod.

The presence of this distributor 22 makes it possible for the liquid to be treated to flow evenly and continuously towards the active face of the sprayer 14.

In accordance with another embodiment of the spraying device according to the invention, as illustrated in FIG. 6, the fluid is introduced to the lower part of the sprayer via a capillary effect and acoustic pumping.

Perfectly even and homogeneous supplying of the active side face of the radial collar 14 is thus obtained.

The embodiment illustrated in FIG. 7 relates to a spraying device intended for providing ultrasonic spraying of fluids brought to high temperatures. It can, in particular, concern liquid metals or alloys.

In such a case, the external perforated distribution pipe which makes possible the annular flow of the liquid is surrounded by an induction heating device carrying the reference 24.

It is very clear that this is a specific heating means and that, in reality, the sprayer can be heated locally by any other means in the vicinity of the means for introducing the fluid.

In such a case, it is, however, advisable to provide heat protection of the converter 10.

To this end, it is first of all possible to interpose, between the converter 10 and the radial collar 14, several coupling rod elements 12, 12'.

This makes it possible to provide a distancing and thus protection of the converter with respect to the induction heating region 24.

When the device according to the invention is applied to the spraying of liquid metals, it will additionally be advisable to place the electroacoustic converter in a leaktight chamber which ensures that it is cooled, for example by circulation of liquid coolants through the double walls of the said chamber carrying the general reference 26.

It is clear that when a number of coupling rod elements are interposed between the converter and the spraying collar, it [sic] will each advantageously have a length equal to a half-wavelength of the axial vibration, the wavelength taking account of the temperature gradient in the rod.

The exact dimensions of the radial element and of the coupling rod will be advantageously chosen to retain the natural frequency of the converter at the targeted temperature.

For example, a sprayer made of titanium alloy using a 20 KHz [sic] converter and intended to operate at a temperature of 650° C., under a peak-to-peak amplitude of 10 μm, will be tuned while cold to a frequency of the order of 21,200 Hz.

The materials will be chosen depending on the temperature level and the required amplitudes.

As had already been shown above, supplying with liquid can also be carried out even via the inside of the spraying device.

The embodiments of FIGS. 8 and 9 illustrate such an internal supplying.

In particular, it will concern channels 28, preferably radial channels, made in the mid-plane of the radial collar 14.

These channels 28 are connected to a central supply channel 30 which emerges in a region of low stress 32 of one of the coupling rod elements 12.

Supplying with liquid, properly speaking, is carried out via a pipe 34 which enters into the rod 12 precisely in the vicinity of a region of low stress of the rod 32.

The sprayer illustrated in FIG. 9 is of the dual-supply type 34, 36. It is more particularly intended to be applied to the case of two liquids which must not be brought into contact in the liquid state for a long time before the spraying, drying and/or solidification stage.

In the specific embodiment illustrated in FIG. 9, it is observed that the two liquid supplies 34 and 36 are of internal type, that is to say that the mixing is carried out in the central channel 30 coupled to the radial channels 28.

For the case when the duration of contact between the two liquids has to be even shorter, it is possible to have recourse to two different types of supply, for example an internal supply of the type illustrated in FIG. 8, in combination with any other type of external supply illustrated in the preceding figures.

The ultrasonic sprayer in accordance with the invention can be applied to the spraying of metals and alloys or of inorganic or organic chemical products (pharmaceuticals, cosmetics) which can be put into the liquid form or into solution, in the form of emulsions or of crystalline suspensions.

It can be used especially in a cooled or heated (case of drying by spray drying), leaktight chamber under inert or active gas pressure or under partial vacuum. The dimensions and the shape of the chamber can be adapted depending on the shape of the sprayer which can have a planar, frustoconical or convex face.

The advantages obtained by virtue of the invention lie essentially in the fact that the throughputs can be high by virtue of the large active surface area of the collar, the particle size distribution tight by virtue of the homogeneity of amplitude and the reliability retained in this sense that the assembly vibrates as a body and coherently.

Moreover, in the case of supplying via the inside, the orifices for introducing the liquid will never be obstructed due to the ultrasonic activity prevailing therein.

By way of example, a radial sprayer operating at 20 KHz [sic] can generate a mist of water drops of approximately 50 microns for a throughput of the order of at least 300 liters/hour and under an amplitude of 10 microns.

Another example of use according to the process relates to the manufacture of powders of tin/lead alloys. An alloy of 62/36/2 type melting at 179° C. is sprayed using a radial sprayer operating at 30 kHz with a peak-to-peak amplitude of 6 microns and a throughput of 30 kg/hour. The powder obtained is 95% less than 80 microns and 56% less than 40 microns.

I claim:

1. A device for the ultrasonic spraying of at least one liquid, comprising:

an electroacoustic converter delivering an axial vibration of given wavelength, at least one coupling rod element, a radial sprayer constructed in the shape of a radial collar having a side surface which projects outwards with respect to the coupling rod element with which it is integral and which is constructed at a node of a half-wavelength of the axial vibration, said sprayer being tuned to the wavelength of the vibration of said converter, and means for introducing said at least one liquid to be sprayed into the immediate vicinity of said side surface of the sprayer, said entire side surface vibrating with a substantially uniform amplitude thereby providing spraying with a compressed spectrum.

2. A device according to claim 1, wherein the side surface of the sprayer is cylindrical, having an axis parallel to an axis of the axial vibration.

3. A device according to claim 1, wherein the side surface of the sprayer is convex.

4. A device according to claim 1, 2, or 3, wherein the means for introducing said at least one liquid to be sprayed are arranged outside the device.

5. A device according to claim 4, wherein the means for introducing said at least one liquid to be sprayed comprises an annular opening producing a direct liquid flow onto an intermediate region of the sprayer arranged such that the liquid flow proceeds to the side surface of the sprayer.

6. A device according to claim 4, wherein said at least one liquid to be sprayed is introduced to a lower part of the sprayer.

7. A device according to claim 4, wherein the sprayer is heated by heating means located in the vicinity of the means for introducing said at least one liquid to be sprayed.

8. A device according to claim 7, wherein the electroacoustic converter is distanced from the sprayer by the interposition of a plurality of coupling rod elements each having a length equal to a half-wavelength of the axial vibration, the half-wavelength being determined as a function of a temperature gradient.

9. A device according to claim 8, wherein the electroacoustic converter is mounted in a cooling chamber.

10. A device according to claim 8, wherein the means for introducing said at least one liquid to be sprayed comprise radial channels, made in a mid-plane of the side surface of the sprayer, said channels being connected to a central supply channel emerging in a region proximate to a node of an axial vibration of the coupling rod element.

11. A device according to claim 4, wherein the means for introducing said at least one liquid to be sprayed contain an annular groove producing a liquid flow that introduces liquid close to a nodal region of the sprayer arranged such that the liquid flow proceeds to the side surface of the sprayer.

12. A device according to claim 1, wherein the sprayer is placed in a leaktight chamber containing a controlled gas atmosphere.

13. A device according to claim 1, wherein a plurality of liquids are introduced simultaneously at a level of said side surface of the sprayer.

14. A device for the ultrasonic spraying of at least one liquid, comprising:

an electroacoustic converter delivering an axial vibration of given wavelength, a radial sprayer constructed in the shape of a radial collar having a side surface which projects outwards with respect to an axial element with which it is integral and which is constructed at a node of a half-wavelength of the axial vibration, said sprayer being tuned to the wavelength of the vibration of the converter, and means for introducing said at least one liquid to be sprayed into the immediate vicinity of said side surface of the sprayer, all of said side surface vibrating with a substantially uniform amplitude thereby providing spraying with a compressed spectrum.

15. A device according to claim 14, wherein the side surface of the sprayer is cylindrical, having an axis parallel to an axis of the axial vibration.

16. A device according to claim 14, wherein the side surface of the sprayer is convex.

17. A device according to claim 14, 15, or 16, wherein the means for introducing said at least one liquid to be sprayed are arranged outside the device.

18. A device according to claim 17, wherein the means for introducing said at least one liquid to be sprayed contain an annular groove producing a liquid flow that introduces liquid close to a nodal region of the sprayer arranged such that the liquid flow proceeds to the side surface of the sprayer.

19. A device according to claim 17, wherein said at least one liquid to be sprayed is introduced to a lower part of the sprayer.

20. A device according to claim 17, wherein the sprayer is heated by heating means located in the vicinity of the means for introducing said at least one liquid to be sprayed.

21. A device according to claim 20, wherein the electroacoustic converter is mounted in a cooling chamber.

22. A device according to claim 17, wherein the means for introducing said at least one liquid to be sprayed consist of an annular opening producing a direct liquid flow onto an intermediate region of the sprayer arranged such that the liquid flow proceeds to the side surface of the sprayer.

23. A device according to claim 14, wherein the sprayer is placed in a leaktight chamber containing a controlled gas atmosphere.

24. A device according to claim 14, wherein a plurality of liquids are introduced simultaneously at a level of the side surface of the sprayer.

25. A device for the ultrasonic spraying of at least one liquid, comprising:

an electroacoustic converter delivering an axial vibration of given wavelength, at least one coupling rod element, a radial sprayer constructed in the shape of a radial collar having a side surface which projects outwards with respect to the coupling rod element with which it is integral, said coupling rod element having a tip, said radial sprayer being constructed axially spaced from said tip at a node of a half-wavelength of the axial vibration, said sprayer being tuned to the wavelength of the vibration of the converter, and means for introducing said at least one liquid to be sprayed into the immediate vicinity of said side surface of the sprayer, said side surface being cylindrical and having an axis parallel to an axis of the axial vibration, all of said side surface vibrating with a substantially uniform amplitude thereby providing spraying with a compressed spectrum.

* * * * *

UNITED STATES PATENT AND TRADEMARK OFFICE

CERTIFICATE OF CORRECTION

PATENT NO. :5,632,445
DATED :May 27, 1997
INVENTOR(S) :Dubruque

It is certified that error appears in the above-identified patent and that said Letters Patent is hereby corrected as shown below:

On the title page:

Item [22], "PCT Filed: Nov. 22, 1991" should read -- [22] Filed: Feb. 9, 1995--; Items [86] and [87] should be deleted;

Item [63], "May 21, 1993" should read - Nov. 22, 1991, filed as PCT/FR91/00930 --; and Column 1, line 4, "May 21, 1993" should read -- Nov. 22, 1991, filed as PCT/FR91/00930 --.

Signed and Sealed this

Seventeenth Day of November, 1998

*Attest:*

Bruce Lehman

BRUCE LEHMAN

*Attesting Officer*

*Commissioner of Patents and Trademarks*